US005320209A

United States Patent [19]

Del Monaco et al.

[11] Patent Number: 5,320,209

[45] Date of Patent: Jun. 14, 1994

[54] DELIVERY CONTROL SYSTEM FOR A PRINTING PRESS

[75] Inventors: Mark Del Monaco, Lombard; Gary R. Gorson, Hawthorne Woods, both of Ill.

[73] Assignee: Rockwell International Corporation, El Segundo, Calif.

[21] Appl. No.: 904,414

[22] Filed: Jun. 25, 1992

[51] Int. Cl.[5] ..... B65G 37/00

[52] U.S. Cl. ..... 198/370; 414/398

[58] Field of Search ..... 198/365, 370; 414/398; 271/295, 298

[56] References Cited

U.S. PATENT DOCUMENTS 3,122,231 2/1964 Pence et al. ..... 198/349.7 X
4,098,195 7/1978 Zander ..... 198/370
4,915,209 4/1990 Canziani ..... 198/365 X
5,054,602 10/1991 Kent et al. ..... 198/370

*Primary Examiner*—Cheryl L. Gastineau
*Attorney, Agent, or Firm*—C. B. Patti; H. F. Hamann

[57] ABSTRACT

A delivery system (20) having a plurality of printing presses (22) to supply printed materials, a plurality of trays (38) being movable past locations of the presses (22), a device for loading (26) the trays (38) from the presses (22), a device for ejecting (28) the printed materials from the trays (38) onto a plurality of positions of a plurality of docks (46) for a plurality of vehicles (48) located at the positions on the dock (46), and a control system (49) for selecting the trays (38) to be ejected onto the docks (46) according to a variable current rate having an average during delivery approximately equal to a selected base rate.

46 Claims, 17 Drawing Sheets

ADVANCED DISTRIBUTION CONTROL SYSTEM

ADVANCED DISTRIBUTION CONTROL SYSTEM

DELIVERY CONTROL SYSTEM FOR A PRINTING PRESS

BACKGROUND OF THE INVENTION

The present invention relates to delivery control systems for a printing press.

In the past, printing presses have been utilized to print a web in the press for newspapers, with the webs being cut and folded such that they are placed in the form of bundles near an output portion of the press. The bundles are placed in a plurality of trays which pass around a loop, and the bundles are ejected from the trays onto chutes in order to deliver the bundles to trucks which then take the bundles to remote locations where they are distributed to subscribers.

The process for delivering the bundles of newspapers to the trucks has been very limited in sophistication, since the distribution systems delivered bundles to routes for the trucks at rates which by definition are rates which are not to be exceeded. The distribution procedure for these prior systems was based upon skipping trays to ensure that the specified delivery rate is not exceeded. The distribution systems assumed that all the trays were full, and knowing the speed of the press and trays, as well as the injection rate from the trays, the systems performed calculations for delivering the bundles to the trucks. However, not all the trays were actually full, and some of the trays were empty.

As a result, the distribution systems of the newspaper bundles was very inefficient. Some of the trays with bundles may pass the injection point, and some of the trays may be selected for ejection which did not actually have bundles in the selected trays. Some groups of bundles may travel around on the trays several times before being delivered in these systems which are based on skipping trays, and these systems take relatively long periods of time to load even high priority routes, which is undesirable and inefficient in delivering the bundles from the press to the truck routes.

SUMMARY OF THE INVENTION

A principal feature of the present invention is the provision of an improved delivery system for a plurality of printing presses.

The delivery system of the present invention comprises, a plurality of the printing presses to supply printed materials, a plurality of trays being movable past locations of the presses, means for loading the trays from the presses, and means for ejecting the printed materials from the trays onto a plurality of positions on a plurality of docks for a plurality of vehicles located at the positions on the docks.

A feature of the present invention is the provision of means for selecting the trays to be ejected onto the dock.

Another feature of the invention is that the trays are selected for ejection in accordance with a variable current rate having an average over the period of delivery approximately equal to a selected base rate.

Yet another feature of the invention is that the current rate may be changed a selected amount.

A further feature of the invention is that the current rate may be increased a selected amount.

Yet another feature of the invention is that the current rate may be decreased a selected amount.

Still another feature of the invention is that the selected current rate represents the actual delivery rate of the printed materials to all positions on the dock.

Another feature of the invention is that the positions on the dock may be checked in order to determine their availability for delivery.

Yet another feature of the invention is that each of the trays may be checked for their availability to deliver the printed materials.

A further feature of the invention is that an assignment window comprising a plurality of trays adjacent the presses may be assigned or reserved for particular trays and position on the dock before delivery.

Still another feature of the invention is that the assigned trays are checked in the assignment window for delivery from a selected tray.

Yet another feature of the invention is that all of the trays may be checked in order to determine the presence or absence of the printed products in the trays.

A feature of the invention is that the current rate is increased responsive to an increased number of empty trays.

Another feature of the present invention is that the current rate is decreased responsive to a decreased amount of empty trays.

Yet another feature of the invention is that the rate of change of the current rate for delivery may be selected.

A further feature of the invention is that the current rate may be increased or decreased by selected increments or decrements.

Another feature of the invention is that a plurality of trays are considered for possible delivery a plurality of docks.

Still another feature of the invention is that the availability of each of the trays is checked for delivery to the plurality of docks.

Yet another feature of the invention is that the presses supply a plurality of different products to the trays, and the system checks each of the products for delivery.

Still another feature of the invention is that the availability of the products in the various trays are checked for delivery to the plurality of docks.

Another feature of the invention is that selected products are delivered by the system onto the positions of the docks.

Yet another feature of the invention is that the current rate for delivery is limited to a maximum amount.

A feature of the invention is that the system provides priorities of delivery to the various positions on the dock.

Another feature of the invention is that the priorities are selected for each of the positions on the docks.

Still another feature of the invention is that priorities are assigned to each of the products to be delivered via the trays.

Another feature of the invention is that the printed materials are delivered first to the positions of higher priority.

A further feature of the invention is that the system delivers the printed material to the positions of highest priority in the event that the selected rate of delivery to the position is less than the production rate of the presses.

Yet another feature of the invention is that the system delivers the printed materials to lesser priority positions in the event that the total of their selected delivery rates is less than the production rate of the presses.

A feature of the invention is that the system provides delivery of the printed materials to the positions on the dock in an improved and efficient manner.

Another feature of the invention is that the delivery system increases the rate of delivery to the positions on the dock.

Yet another feature of the invention is that products are selected for delivery only from the trays having a printed product.

Still another feature of the invention is that trays having no product are not selected for delivery.

Further features will become more fully apparent in the following description of the embodiments of this invention, and from the appended claims.

DESCRIPTION OF THE PREFERRED EMBODIMENTS

Figure 1:
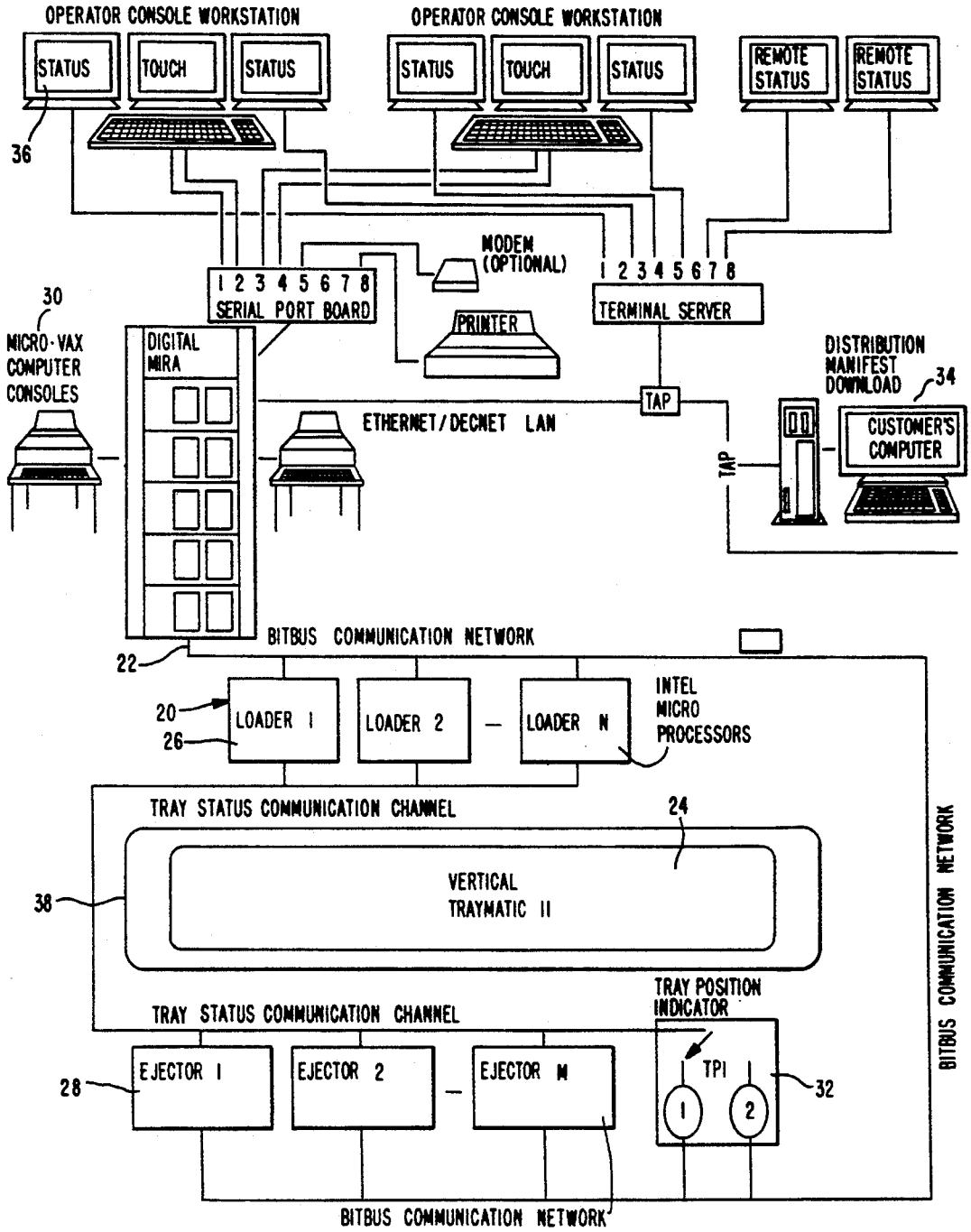
FIG. 1 is a block diagram of a printing press having a delivery system of the present invention.
Figure 2:
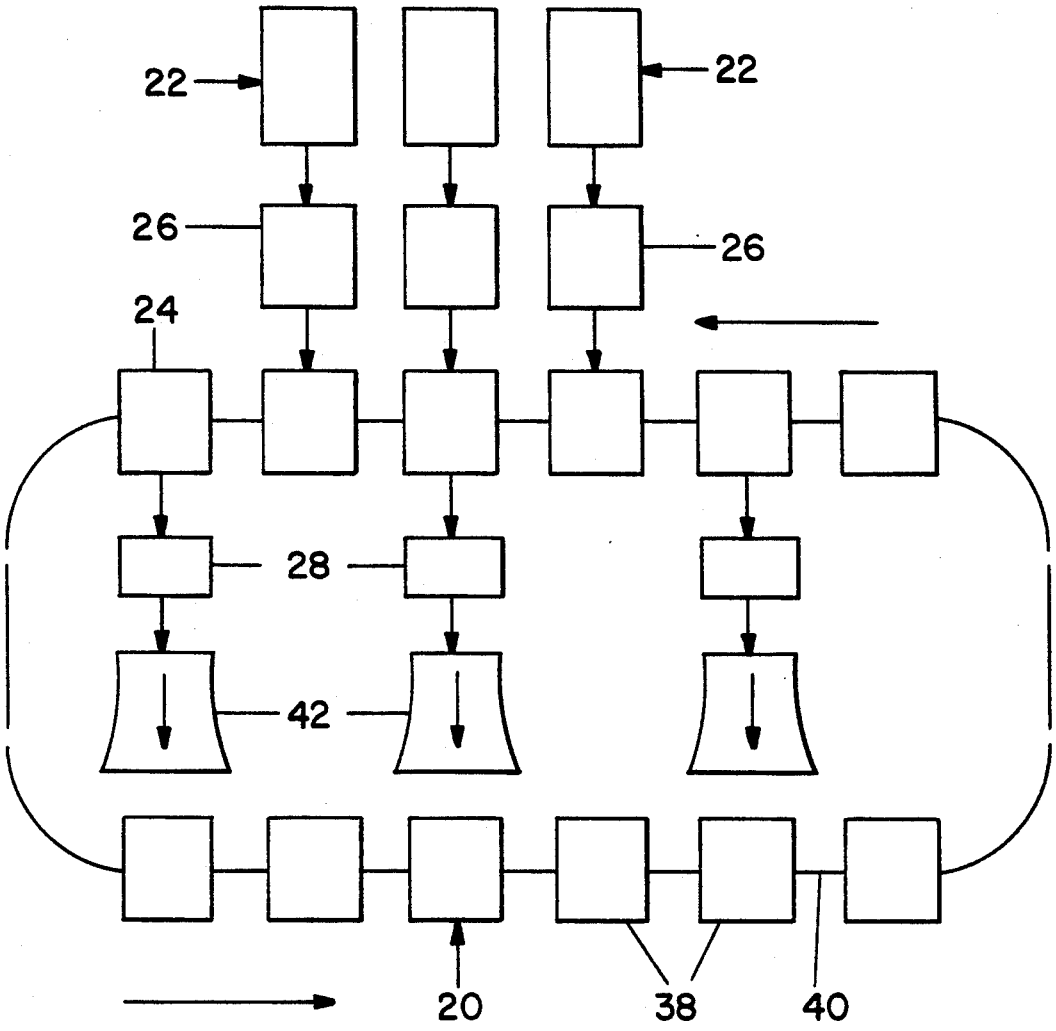
FIG. 2 is a diagrammatic view of the delivery system of FIG. 1.
Figure 3:
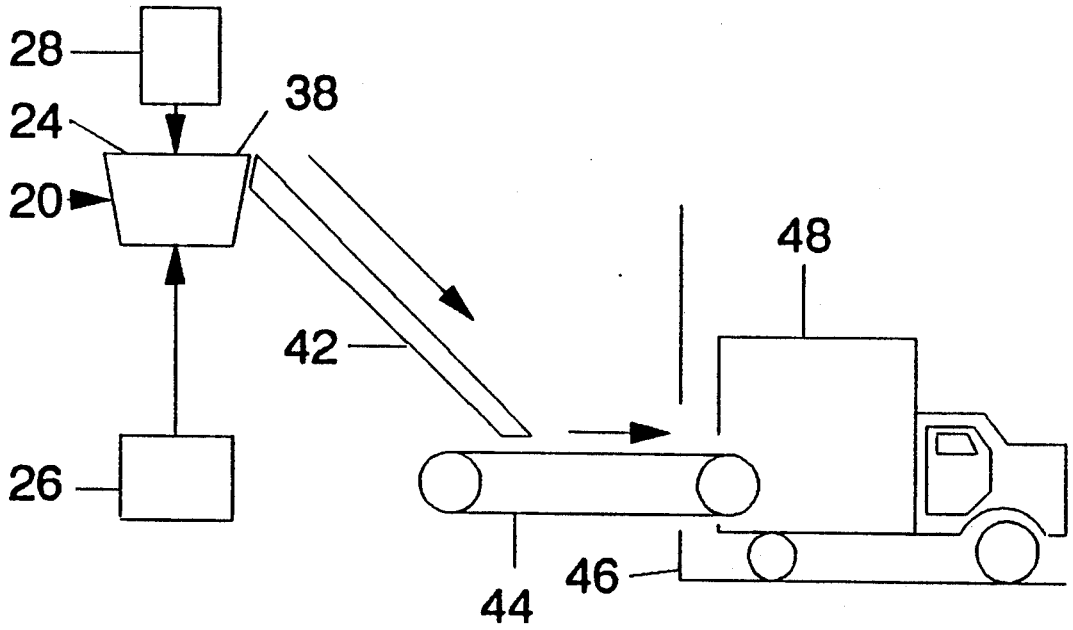
FIG. 3 is a side elevational view of the delivery system.

Referring now to FIGS. 1–3, there is shown a control or delivery system generally designated 20 for a printing press generally designated 22. In particular, the delivery system 20 controls the delivery of the output from a plurality of presses 22 in the form of newspaper bundles from the press 22, such as for newspaper routes.

The press 22 has a tray assemble 24 having a plurality of buckets or trays 38 which pass around a loop to receive and distribute the bundles, as will be seen below. The press 22 has a plurality of loaders 26 which receive bundles from a plurality of the presses 22 as the newspapers pass from the presses 22. The loaders 26 have microprocessors or computers which communicate with other parts of the control system 20, and the loaders 26 place bundles of newspapers on the separate trays 38 of the tray assembly 24. Also, the press 22 has a plurality of ejectors 28 which remove the bundles under control from the trays 38 of the tray assembly 24, and place the bundles on the truck docks 46 for a plurality of routes. The ejectors 28 also have microprocessors or computers which communicate with the remainder of the control system 20.

The control system 20 has a master control 30 having a computer which controls the loaders 26 and ejectors 28 in order to distribute the bundles from the ejectors 28 to suitable chutes 42 to the truck docks 46, with one chute 42 being associated with each of the ejectors 28. In a suitable form, the presses 22 may have a number of ejectors 28, such as 23, with each having a chute 42 and 23 associated docks 46, or 23 positions on the dock 46 in order to receive the newspapers from the chutes 42 for trucks 48 located at the various docks 46.

The control system 20 may have a tray position indicator 32 having a computer which synchronizes the operation of the loaders 26 and ejectors 28. The tray position indicator 32 has a plurality of sensors in order to sense the position of the trays 38 of the tray assemble 24, and indicate the detected position of the trays 38, as well as the speed of the trays 38 for use by the system 20.

The system 20 has an additional computer 34 which downloads information, such as truck routes and newspaper products, to the main computer 30 of the system 20. The system 20 further has a plurality of computers 36 at an operator interface of the system 20. The computers 36 are utilized by the operator to access the various work stations, and the computers 36 have suitable screens in order to indicate the status of the system 20. The computers 36 also have suitable printers in order to print reports from the system 20.

With reference to FIGS. 2 and 3, the multiple presses 22 are each associated with a separate loader 26 in order to receive bundles of the newspapers from the different presses 22. As shown, a plurality of trays 38 of the tray assembly 24 receive bundles from the loaders 26 under control as the trays 38 pass around a loop 40 of the tray assembly 24 in the region of the loaders 26. In a preferred form, the loaders 26 place two bundles in each of the trays 38 as the trays 38 are aligned with the loaders 26 during each cycle of the loop 40. In turn, the trays 38 under control of the system 20 place the bundles by the ejectors 28 onto separate chutes 42 as the trays 38 pass and are aligned with the chutes 42. The bundles of newspapers then pass from the chutes 42 to separate conveyors 44 at the various docks 46 for the trucks 48 located at the docks 46. The conveyors 44 may actually place the bundles, which are assembled into the actual newspapers at other remote locations, inside the trucks 48 for convenience of the truck drivers and operators of the system 20. During the time of distribution of the bundles from the presses 22 to the trucks 48, both the presses 22 and the trays 38 are operated at a constant speed.

In operation of the control or system 20, there are two separate aspects of the delivery system 20 which are coordinated with each other, a rate optimization of the system 20, and a priority determination of the system 20. In the event that all of the trays 38 are full, with two bundles for each tray 38 having possible different products, there exists a maximum delivery rate of the system 20, such as for example, 360 bundles minute. Hence, in this configuration, if every other tray 38 is ejected, the resulting delivery rate would be 180 bundles/minute in this example, such that every other tray 38 may be skipped in order to achieve this result. However, in the usual configuration of the system 20 and presses 22, the trays 38 are not completely full, and account must be taken in the system 20 for this factor.

Prior to operation of the system, the operator supplies the following information for each dock 46 and truck 48 to the system: (a) a base rate of delivery for the system 20 for each product and a given dock, (b) the number of bundles desired for each product for a given dock 46, and (c) the priority for each product and a given route or a dock 46 associated with a truck 48 and Route. For example, the system 20 may be supplied with a base rate of 90 bundles/minute for a Route corresponding to a truck 48, which remains the average rate of delivery for the selected dock 46 over the term of the Route for the given truck 48. A high priority or high base rate may be given to a particular truck 48 which must be at a remote location for delivery fairly quickly, while a lower base rate and priority may be given to a Route when there are less expectations of a quick delivery. An example of a high priority route may be a site such as an airport where it is necessary to supply the newspapers at an earlier time.

In the optimization system for the delivery system 20, the delivery rate of the bundles is determined by the number of trays 38 that are skipped during operation of the system 20. Thus, if the program of the associated computer desires to slow the delivery of bundles to a given dock 46, then an additional numbers of trays 38 are skipped by the system 20. On the contrary, if the program of the system 20 desires to increase the rate of delivery to the docks 46, then a lesser number of trays are skipped at this time.

Figure 4:
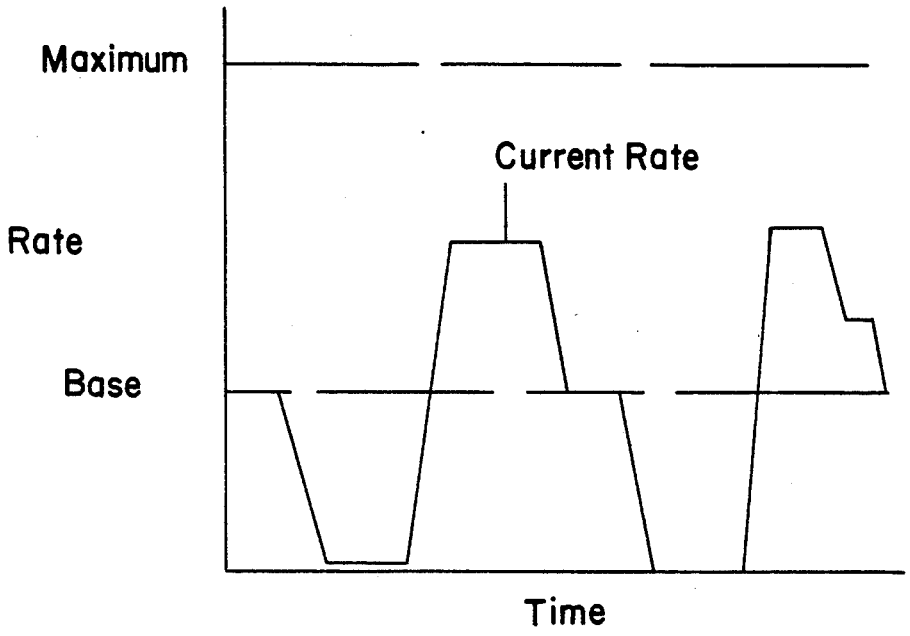
FIG. 4 is a chart showing the current rate of delivery with respect to time.

In the system 20, there is a base rate of delivery supplied by the operator to the computer, as previously discussed, and a current rate of optimization counters which is the actual rate of delivery at a given time. With reference to FIG. 4, where the current rate is plotted against time, the current rate is varied by the system during delivery in a given Route R, such that the resulting average delivery over the life of the Route R approximates the given base rate. Thus, as shown, the current rate is automatically raised and lowered by the system in order to drive the actual delivery rate of an associated dock 46 to the given base rate which is shown as a reference level in the graph of FIG. 4. Initially, as shown, the current rate is set equal to the given base rate. In the event that all of the trays 38 are full, the programs could merely skip a calculated number of the full trays 38 to achieve this result. However, in actual operation, the trays 38 are rarely all full, and account must be taken of their actual configuration in order to achieve the base delivery rate. As will be seen below, the current delivery rate is dependent upon a count of empty trays (Empty_Tray_Count), and the existence of empty trays in the system 20 results in a modification of the current delivery rate. Thus, the current delivery rate is dependent upon the Empty_Tray_Count.

Figure 6:
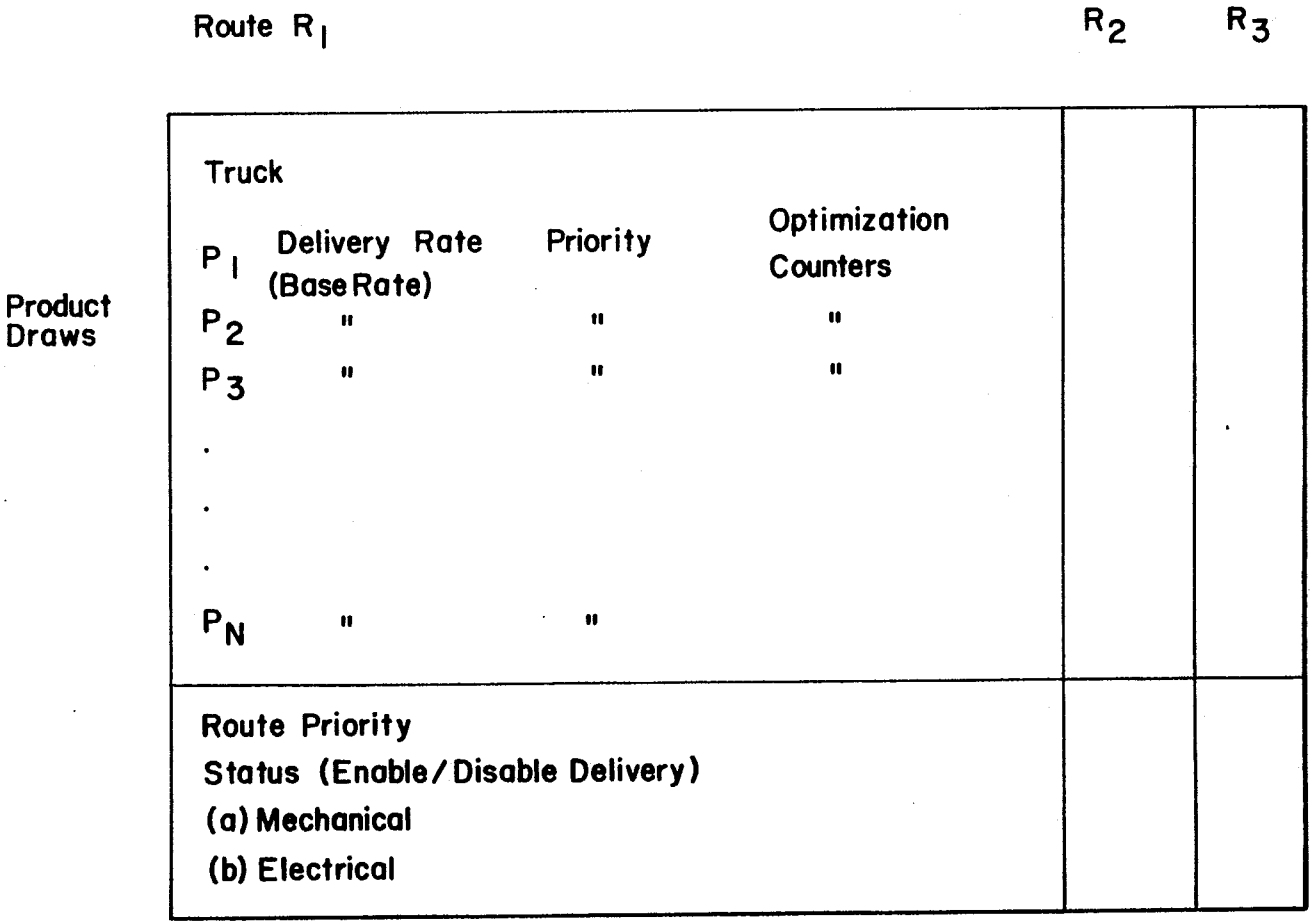
FIG. 6 is a list of data utilized by the delivery system of the present invention.

With reference to FIG. 6, the program for the computer utilizes various parameters which are defined below:

(1) Maximum Rate: This rate is a rate of delivery which cannot be exceeded by the presses 22, and serves as a limit for the current rate of the optimization counters. In the example discussed above, the maximum rate would be 360 bundles/minute;

(2) Up Trigger: This counter serves as the empty tray counter, and indicates how many empty trays must pass a given position before the current rate counter is incremented upwardly;

(3) Down Trigger: This counter indicates how many trays must be ejected at the current rate before the current rate counter is decremented or decreased downwardly;

(4) Up Increment: This term indicates how big a step or change in rate should be made upwardly in the current rate counter in order to indicate how rapidly the current rate counter should be increased each time the current rate counter is incremented; and (5) Down Increment: This term indicates how big a step or change in rate should be made downwardly in the current rate counter in order to indicate how rapidly the current rate counter should be decreased each time the current rate counter is decremented.

During operation of the system 20, the program also accounts for the assigned priorities of the various trucks 48, since more than one truck 48 may be supplied with the desired bundles at a given time. Hence, an indication of a Priority 1 for a certain truck 48 results in delivery first to this truck 48, and trucks 48 having lesser priorities, such as Priority 2, will be serviced next. Hence, the newspaper products are passes to the higher priority routes first in accordance with both the priority rate and base rate supplied by the operator for each truck 48.

Figure 5:
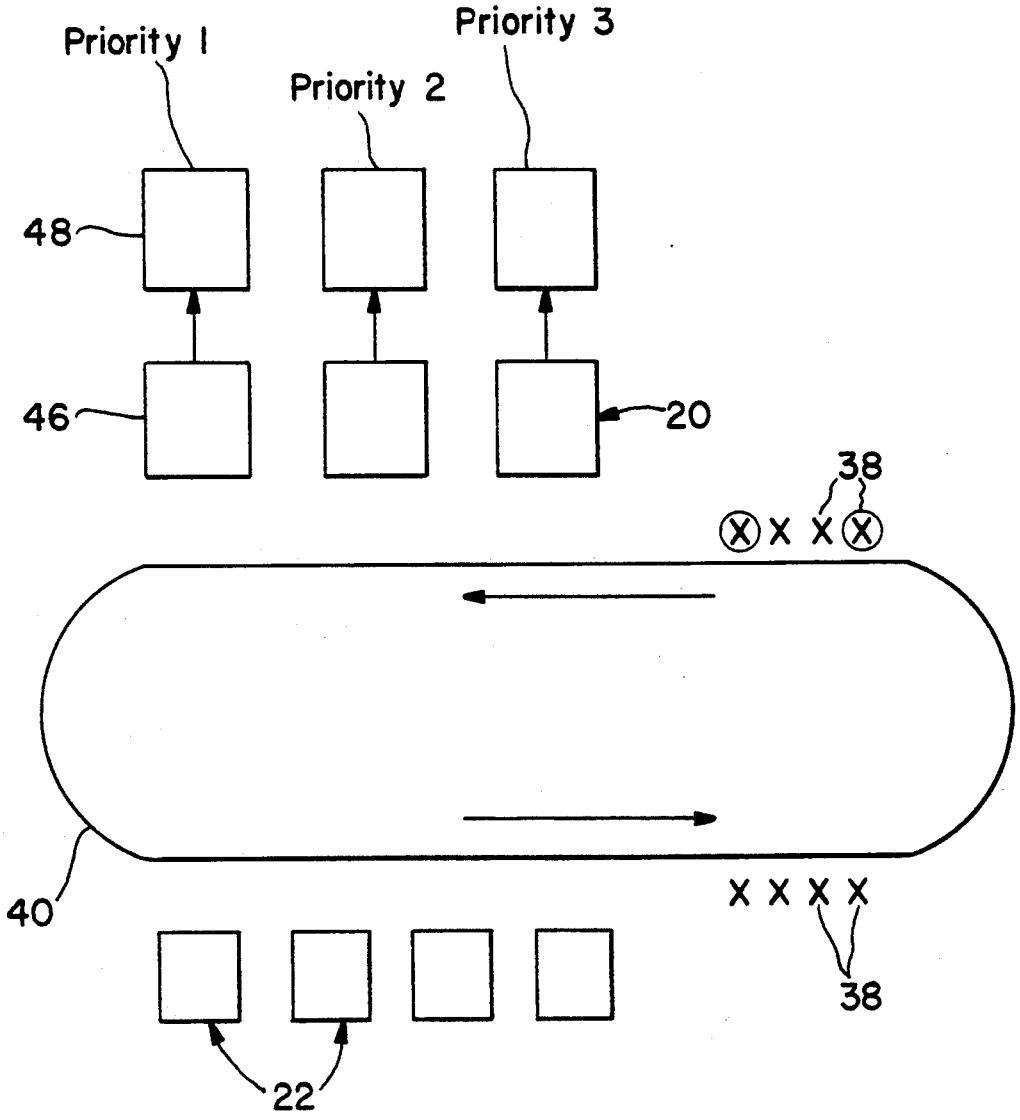
FIG. 5 is a diagrammatic view of the delivery system of the present invention.

With reference to FIG. 5, there is shown a plurality of presses 22 for printing and supplying a plurality of bundles of newspapers to the trays 38 in the loop 40 at a specified production rate of the presses 22. Also shown is a plurality of trucks 48 at the docks 46 each having a given priority, such as priority 1, priority 2, and priority 3. Also shown are the trays 38 which are indicated by "x" around the loop 40, and certain of the trays 38 being encircled which indicates that only these latter trays 38 may be loaded as fast as the presses 22 supply bundles to the trays 38.

Now, if the production rate of the presses 22 is less than the requested rate for a priority 1 truck 48, then all of the bundles will be supplied to the priority 1 truck 48 even if all of the trays 38 cannot be loaded at once, while the remaining trucks 48 with lesser priority will wait until completion of the loading of the priority 1 truck 48. In the event that all of the trays 38 cannot be loaded all at once, then the trays 38 are permitted to pass around the loop 40, and bundles from the trays 38 will be loaded on the subsequent loops 40 or passage of the trays 38, while additional bundles are loaded onto the trays 38 by the presses 22.

In the event that the production rate from the presses 22 is greater than the rate of Priority 1, then bundles are also supplied from the trays 38 to the trucks 48 of priority 2. Further, in the event that the production rate of the presses 22 is greater than the combined rates of the Priority 1 and Priority 2 trucks 48, then the bundles from the trays 38 will also be supplied to the truck 48 of priority 3. In this manner, the priorities determine which trucks 48 will be serviced first in order to increase the efficiency of the system 20 in delivering the bundles to trucks 48 on a rush basis, as well as determining when the production and the delivery of the system 20 will be completed. Of course, more than one truck 48 may have the same priority in which case each of the trucks 48 of the same priority are delivered the same.

With reference to FIG. 6, there is shown a Table of parameters or variables assigned to each Route $R_1$, $R_2$, $R_3$, . . . $R_m$ corresponding to each dock 46 and truck 48 positioned at a given dock 46, and each Route having a plurality of Product Draws $P_1$, $P_2$, $P_3$, . . . $P_n$ corresponding to different bundles or products for each Route R. The Table has information which is filled into the computer by the operator of the system 20 including the delivery or base rate of each product P for a given Route, the priority of each product for the given Route, and Optimization Counters assigned for each Product P of each Route R, such as the Current Rate Counters and Trigger Counts, with the Optimization Counters being utilized to store the respective information during operation of the program. As will be seen below, the program has Optimization Counters for each of the Product Draws.

Thus, each Route includes this data in the memory of the computer, and also each Product has this data in the memory of the computer for each Route. Further, each of the Product Draws may be enabled or disabled in the system 20. As shown, the data in the Table of FIG. 6 also has a variable for the Route Priority, and the Status of the Route, including an enable or disable condition for the Route due to mechanical or electrical factors in the system 20. For example, a given Route may be disabled if the truck 48 is not yet properly located at the specified dock 46, or if the trays 38 are not in operation.

Figure 7A:
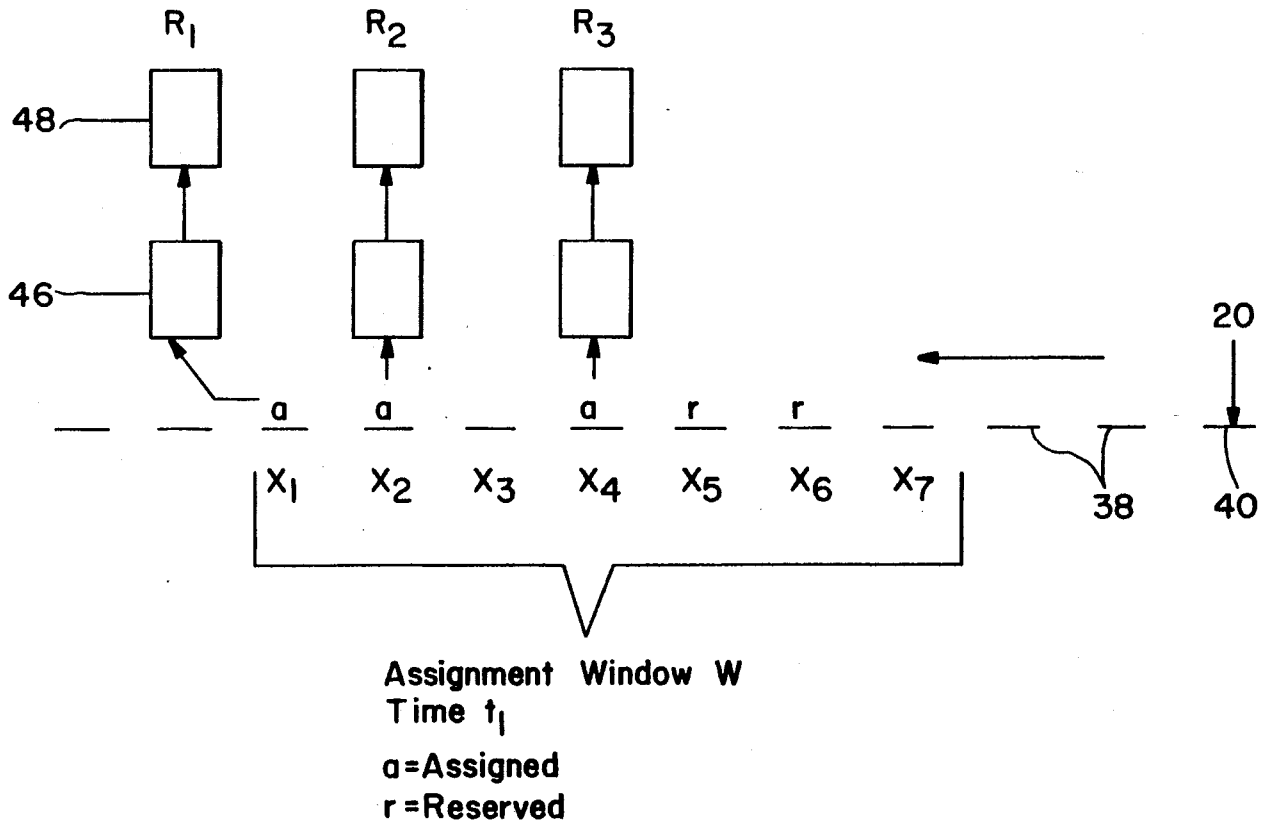
FIGS. 7*a* and 7*b* are diagrammatic view showing an assignment window utilized in the system of the present invention.

With reference to FIG. 7*a*, the program in the computer defines an Assignment Window W of the trays 38. shown, the Assignment Window W at the time $t_1$ in this As shown, the Assignment Window W at the time $t_1$ in this case has a plurality of trays $x_1, x_2, x_3, \ldots, x_7$, where the tray $x_1$ is the first tray 38 which may be considered for the dock 46 and truck 48 of the first Route $R_1$ due to the speed of the trays 38 in the loop 40 relative to the dock 46 of the Route $R_1$, and where the tray $x_7$ is the last tray 38 to be considered in the Assignment Window W for the Route $R_1$. As shown, the trays 38 may be designated with the reference "a" which indicates that these trays 38 have already been assigned for deliver to a dock 46, and the term "r" which indicates that the tray has already been reserved for a dock 46. The program in the computer designates the variable Tray_Number as the first tray 38 available in the Assignment Window W for delivery . In this case, the tray $x_1$ has already been assigned to the Route $R_1$, tray $x_2$ has already been assigned to the Route $R_2$, the tray $x_4$ has already been assigned to the Route $R_3$, the tray $x_5$ has already been reserved for one of the Routes, and the tray $x_6$ has already been reserved for one of the Routes, while the remaining trays $x_3$ and $x_7$ of the assignment Window W have not yet been assigned or reserved.

Figure 7B:
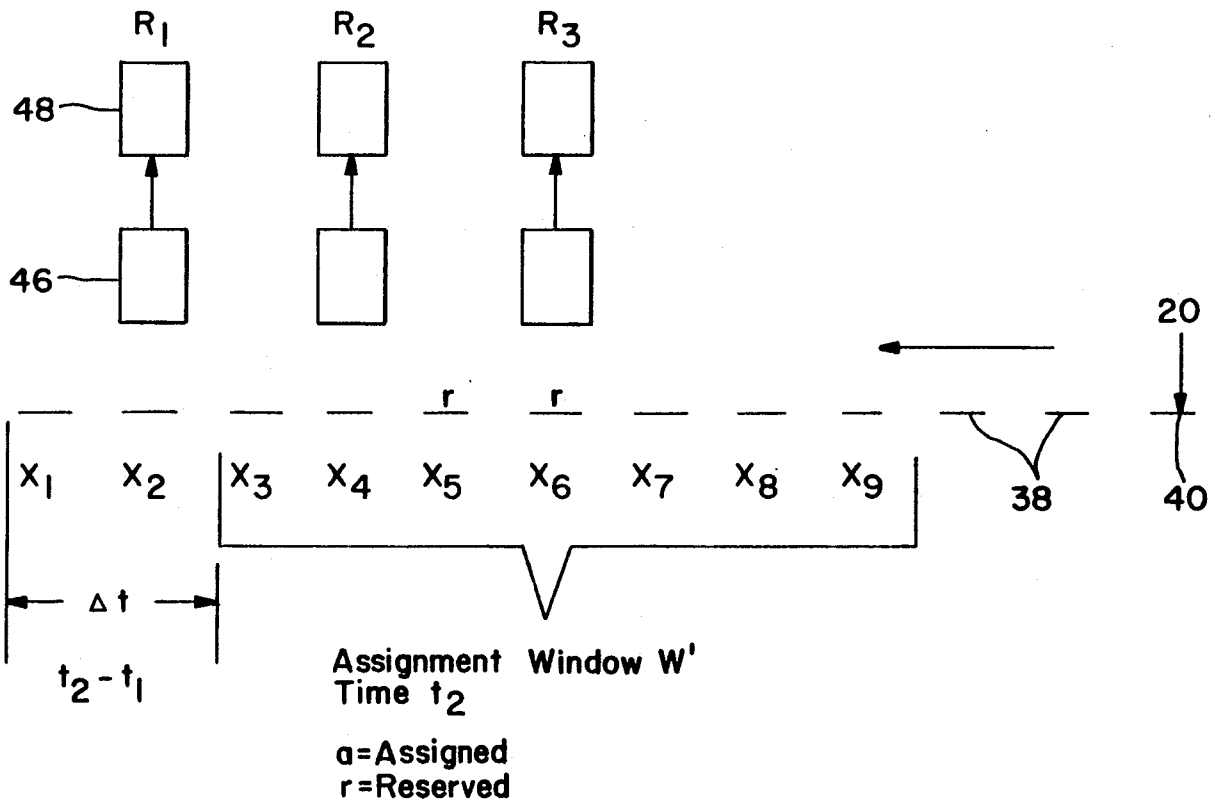

With reference to FIG. 7*b*, the loop 40 with the trays 38 of FIG. 7*a* are shown at the time $t_2$, where the elapsed time is (delta t)$=t_2-t_1$. As shown, the trays $x_1$, $x_2$, and $x_3$ have been delivered to the Routes $R_1$, $R_2$, and $R_3$. Also, the trays $x_5$ and $x_6$ have been reserved for the Route $R_1$, and will be delivered to the dock 46 for this Route R. During this time, the Assignment Window W has remained the same, and will remain the same throughout use of the program 49.

Figure 8A:
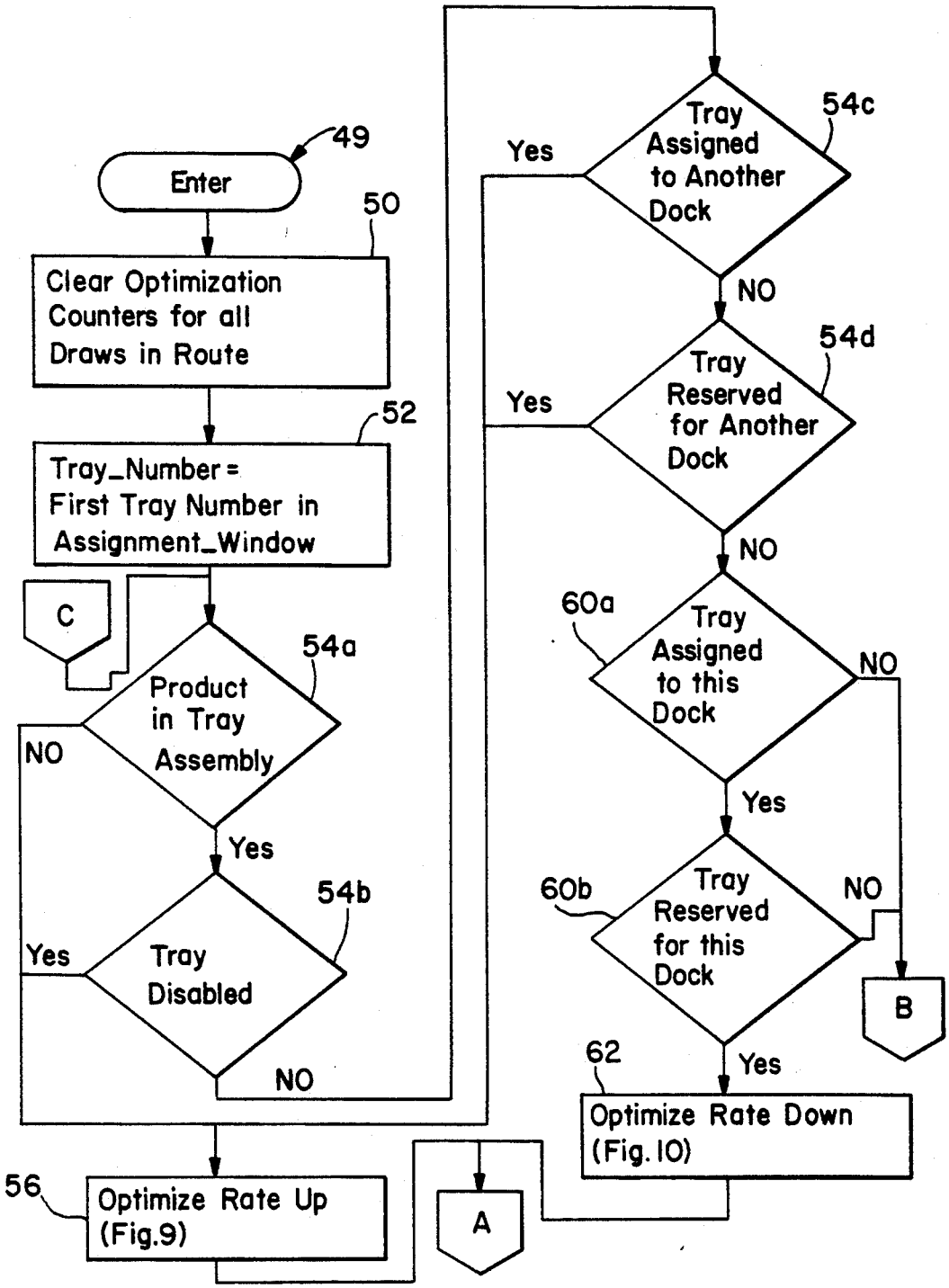
FIGS. 8*a*, 8*b*, and 8*c* are flow charts showing a rate optimization program for the system of the present invention.
Figure 8B:
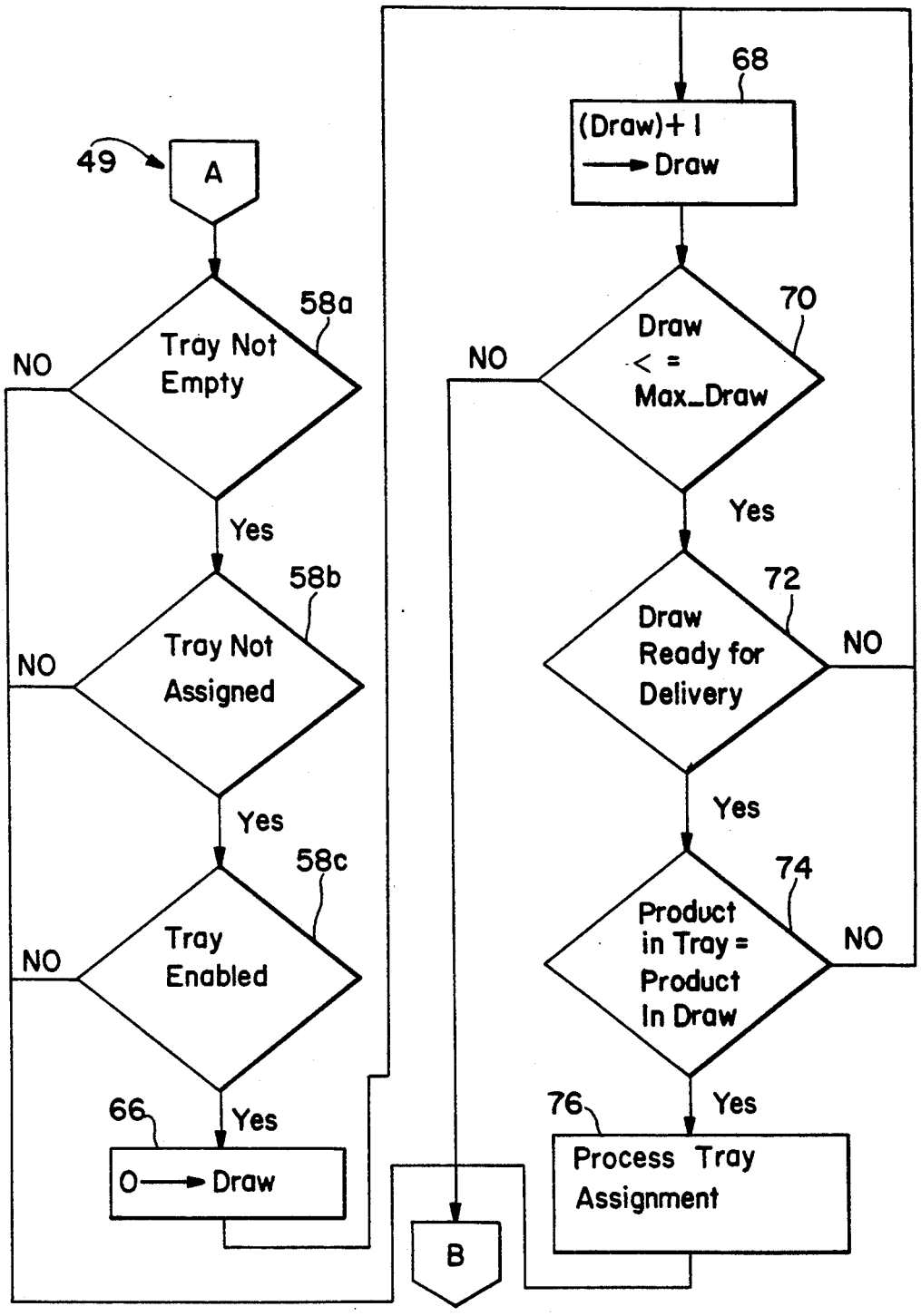
Figure 8C:
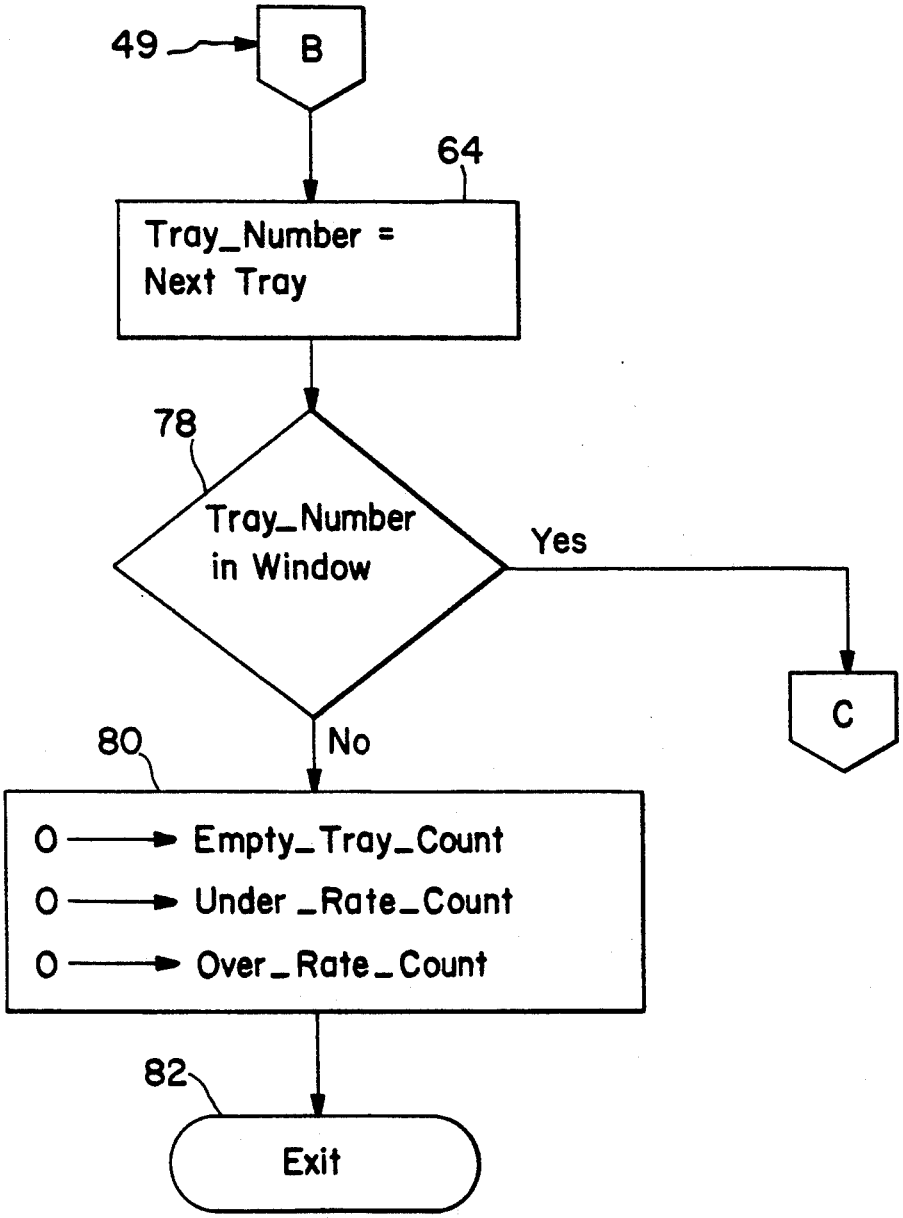

The main program or routine 49 of the Rate Optimization for bundle delivery is shown in FIGS. 8*a*, 8*b*, and 8*c*. First, the program 49 initializes at the Optimization Counters at location 50, such as the Current Rate and Trigger Counts, for all of the Product Draws in a given Route R. Next, at location 52 the program 49 defines the variable Tray_number as the first tray 38 in the Assignment Window W, which is the tray $x_1$ in the discussion associated with FIGS. 7*a* and *b*. As will be seen below, the program 49 will subsequently be repeated for every Product and dock 46 or Route R corresponding to the dock 46 in the order of Priority.

Next, the program 49 makes a decision at 54*a*, 54*b*, 54*c*, and 54*d* where the program 49 considers the condition of the tray 38 defined as Tray_Number, with the program 49 checking one tray 38 at a time. In the event that there is (a) no Product in the assigned tray 38, i.e., the particular tray 38 assigned Tray_number, (b) the assigned tray 38 is disabled, (c) the particular tray 38 is assigned to a dock 46 different than the present dock 46, or (d) the particular tray 38 is reserved to a dock 46 different than the present dock 46, then the program 49 take the Yes branch of the decisions 54*a*, *b*, or *c*. Under this condition, the program 49 passes at location 56 to the subroutine Optimize Rate Up 51 of FIGS. 9*a* and 9*b* which, after completion, returns to the main routine 49 at the decision 58*a*. Generally, the subroutine Optimize Rate Up 51 will increase the Current Rate since this particular tray 38 may not be used. The subroutine 51 will be discussed in detail below.

With reference to FIGS. 8*a*, *b*, and *c*, in the event that any of the decisions 54*a*, *b*, *c*, or *d* takes the No branch to the decisions 60*a* and 60*b* under which condition the selected tray 38 may be used, then the program 49 checks to determine whether the particular tray 38 has been assigned to or reserved for this particular dock 46. In the event that the decision is Yes, then the program 49 transfers to the subroutine Optimize Rate Down 53 of FIG. 10*a* and *b*, after which the subroutine 53 return to the program 49 at the decision 58. Generally, the subroutine Optimize Rate Down 53 decreases the Current Rate since the particular tray 38 may be used presently. In the event that the decisions 60*a* or *b* is No, then the program 49 transfers to the location 64 where the Tray_Number designating the particular tray 38 is changed to prepare to check the next tray 38, as will be discussed below.

When the program 49 executes at the decisions 58*a*, *b*, and *c*, then the system 20 checks to determine whether the particular tray 38 may be used. In the event that the particular tray 38 may be utilized on the Yes branch, i.e., (a) the particular tray 38 is not empty, (b) the particular tray 38 is not assigned elsewhere, and (c) the particular tray 38 is enabled, the program 49 passes to the location 66. However, in the event that the decisions 58*a*, 58, 58*c* are not satisfied, then the program 49 transfers to the location 64, which will be later discussed.

At the location 66, the program 49 stores a 0 in the term Draw in the memory of the computer, and then passes to the location 68 where the term Draw is incremented by 1. The program 49 then passes to the decision 70 where the checks whether the term Draw is less than or equal to the term Max_Draw which is the maximum amount of draws in the system 20. In the event that the term Draw is less than or equal to the limit, the program 49 passes to the decision 72. In the event that the term Draw is greater than the limit Max_Draw, then the program 49 transfers to the location 64 where another tray 38 will be checked, which will be described below.

At the decision 72, the program 49 determines whether the particular Draw is ready for delivery according to the status assigned to this particular Draw. If not, the program 49 transfers on the No branch to the location 68 where the program will check a further Draw. If the particular Draw is ready for delivery on the Yes branch at the decision 72, then the program 49 passes to the decision 74. If the Product in the particular tray 38 is not the same as the Product requested in the Draw, then the program 49 returns to location 68 where a subsequent tray 38 will be checked.

In the event that the Product in then particular tray 38 is the same as the product requested in the Draw, then the program 49 passes from the decision 74 to the location 76 where the computer sends a signal to eject either the assigned tray a or reserved tray r to the appropriate dock 46 of the given Route, or the program 49 will make subsequent assignments for the trays 38. In this manner, all the Draws are checked until one is satisfied in the program 49.

At this time, the program 49 passes to the location 64 previously referenced in the program 49. Here, the program 49 defines the term Tray_Number to be the next tray 38 in the loop 40, and then passes to the decision 78. In the event that the new Tray Number is located in the Assignment Window W at this time, the program 49 returns on the Yes branch to the decisions 54, where this process is repeated for the next tray 38.

In the event that the selected Tray_Number is not in the Assignment Window W, then the program 49 transfers to the location 80 on the No branch of the decision 78. At the location 80, the value 0 is stored in the variables or terms Empty_Tray_Count, Under_Rate_Count, and Over_Rate_Count, for a purpose which will be described below, and the program 49 then passes to the location 82 in order to exit the program 49 and continue the assignment processing, with the program 49 being periodically repeated.

Figure 9A:
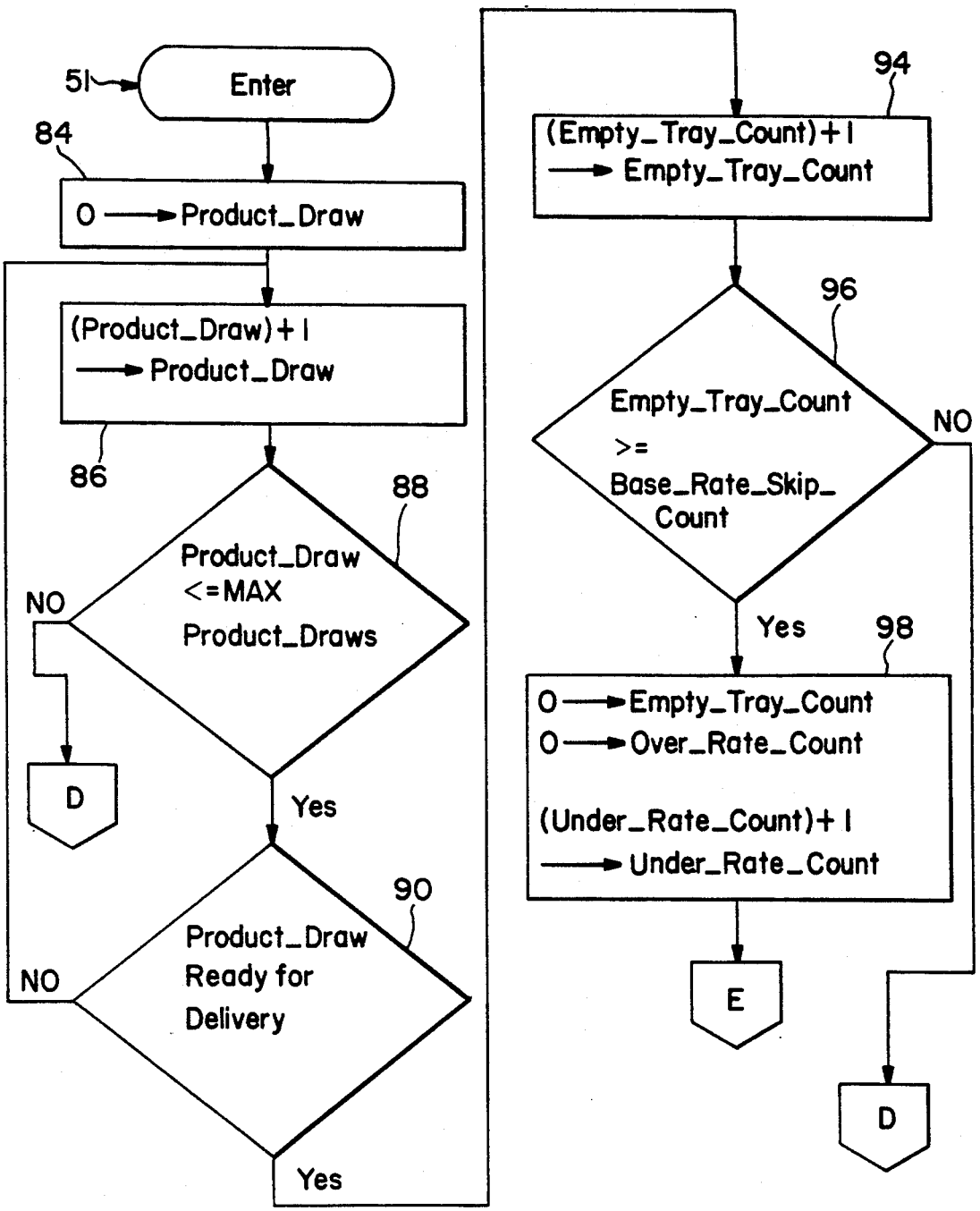
FIGS. 9*a* and 9*b* are flow charts showing a program subroutine for determining an increase in the rate of delivery in the system of the present invention.
Figure 9B:
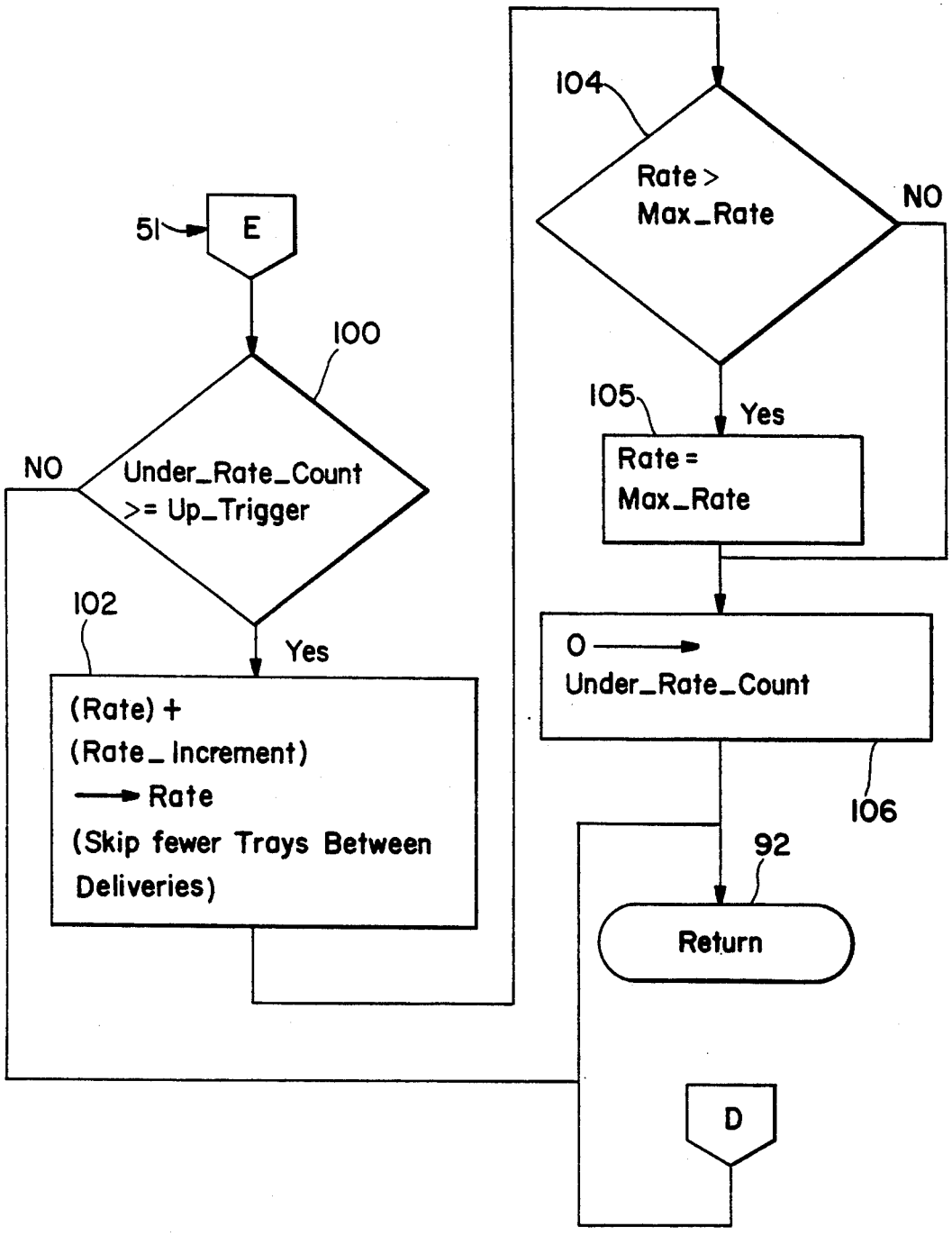

The program subroutine Optimize Rate Up 51 discussed in connection with the program 49 of FIGS. 8*a*, *b*, and *c* is shown in FIGS. 9*a* and *b*. The program 49 enters the subroutine or program 51 at the location 84 where the term or variable Product_Draw is initialized to 0. Next, the program 51 passes to the location or process 86 where the term Product_Draw is incremented by 1, and the subroutine 51 then passes to the decision 88. At this location, if the term Product_Draw is lees than or equal to the maximum of Product_Draw (MAX Product_Draws) possible, the subroutine 51 passes to the decision 90, while if the current term Product_Draw is greater than MAX Product_Draw, then the subroutine 51 passes to the end of the subroutine 51 at the location 92 where the subroutine 51 returns to the program 49. At the decision 90, if the chosen Product_Draw is ready for delivery, then the program 51 passes to location 94 on the Yes route of the decision 90, while if the chosen Product_Draw is not ready for delivery, the subroutine 51 returns to the location 86 where further Product Draws are checked. Thus, the subroutine 51 checks all the Product Draws or Products for a specific Route R until it either finds one ready for delivery, or if none are ready for delivery, then the program 51 returns to the program 49 at the location 92.

At the location 94 of the subroutine 51, the program 51 further processes the selected Product or Product Draw, and increases the Current Rate as empty trays 38 pass the dock 46 of the given Route R. At this time, the term or variable Empty_Tray Count of the particular Product Draw is incremented by 1, and the program 51 then passes to the decision 96. At this time, the term Base_Rate_Skip Count represents the number of trays 38 which should be skipped in order to limit the amount of empty trays 38 which pass the Route or dock 46 being processed. In the event that the term Empty_Tray_Count is less than the limit Base_Rate_Skip_Count, then the program 51 takes the No branch to the location 92 at the end of the subroutine 51, and then returns to the program 49. However, if the term Empty_Tray_Count is greater than or equal to the limit Base_Rate_Skip_Count, then the subroutine 51 passes to the process or location 98 where 0 is stored in both the terms Empty_Tray_Count and Over_Rate_Count, while the term Under_Rate_Count is incremented by 1 in order to reinitialize the terms Empty_Tray_Count and Over_Rate_Count, and indicate by term Under_Rate_Count how many times the subroutine 51 is below the base delivery rate, after which the subroutine 51 passes to the decision 100.

At the decision 100, the subroutine 51 checks the status of the term Under_Rate Count. If the term Under_Rate_Count is less than the term Up_Trigger, then the subroutine 51 transfers to the end of the subroutine 51 at the location 92, and then returns to the main program 49. However, if the term Under_Rate_Count is greater than or equal to the term Up_Trigger, then the subroutine 51 passes to the location or process 102. Thus, when the term Under_Rate_Count reaches the limit Up_Trigger, the program 51 determines how fast to respond to making change of rates. The user may supply the term Up_Trigger to the computer. At the location 102, the term Increase_Rate indicates the Current Rate which is established relative to the Base Rate, previously described. Thus, at this time the term Rate is incremented by the term Rate_Increment in order to provide the Current Rate and drive the system 20 towards the selected Base Rate. The magnitude of the term Rate_Increment may be selected by the operator in order to indicate how fast the current Rate or Increase_Rate should be changed in order to skip fewer trays 38 between deliveries.

The subroutine 51 then passes from the process 102 to the decision 104 where the term Rate of the particular Product Draw is checked against a limit Max_Draw. In the event that the term Rate is less than or equal to the term Max_Rate, the subroutine 51 passes on the No branch to the location 106 where the term Under_Rate_Count is reinitialize to 0 At this time, the term Rate has been raised a step, and it is desired to begin again in the instance where the program 49 is under the delivery rate. The subroutine 51 then passes to the location 92 where it returns to the main program 49. However, in the event that the term Rate is greater than the term Max_Rate, then the program 51 passes to the location 106 where the term Rate is set equal to the term Max_Rate in order to limit the term Rate to this amount, after which the subroutine 51 passes to the end of the subroutine 51 at the location 92 where the subroutine 51 returns to the main program 49.

Figure 10A:
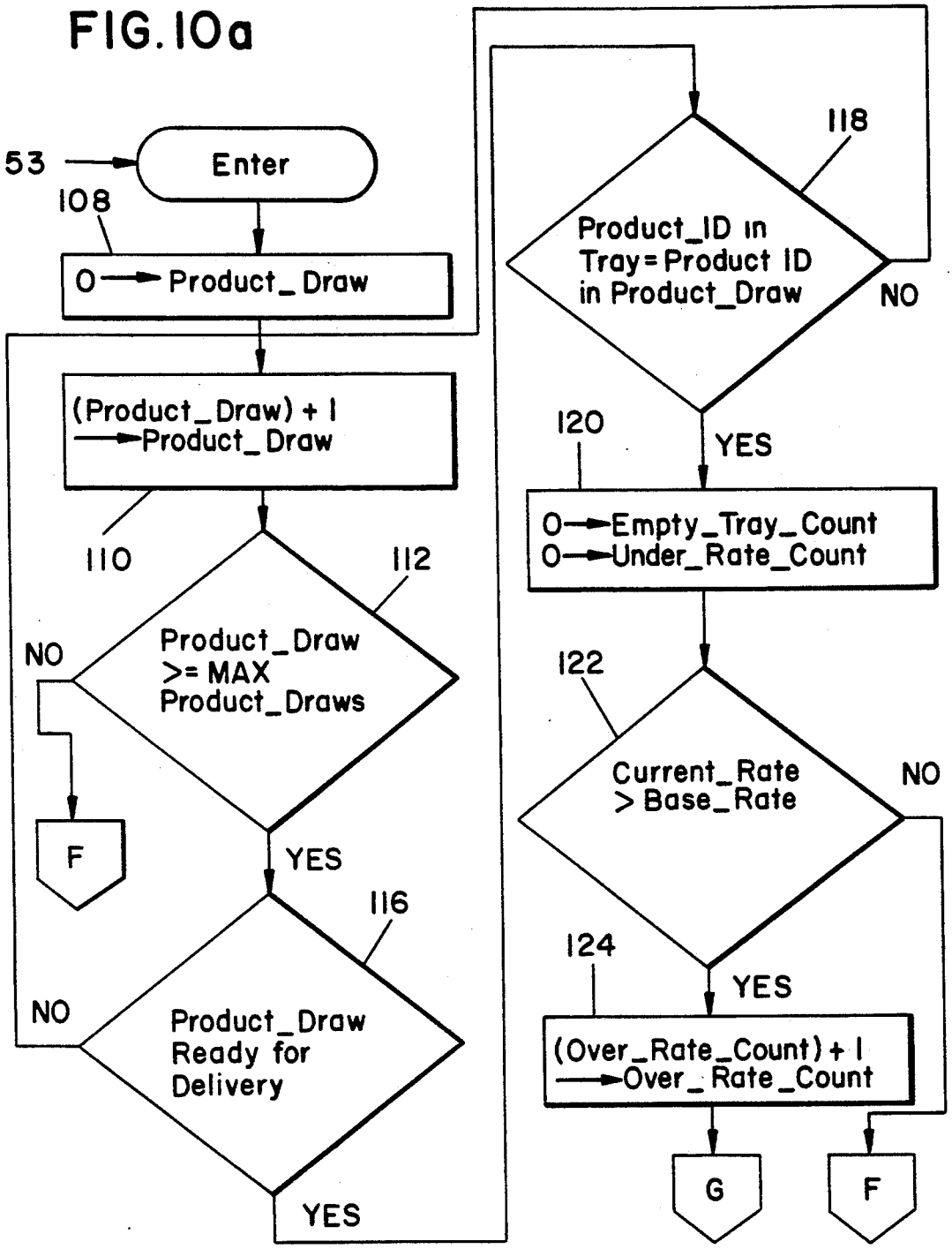
FIGS. 10*a* and 10*b* are flow charts showing a program subroutine for determining a decrease in the rate of delivery in the system of the present invention.
Figure 10B:
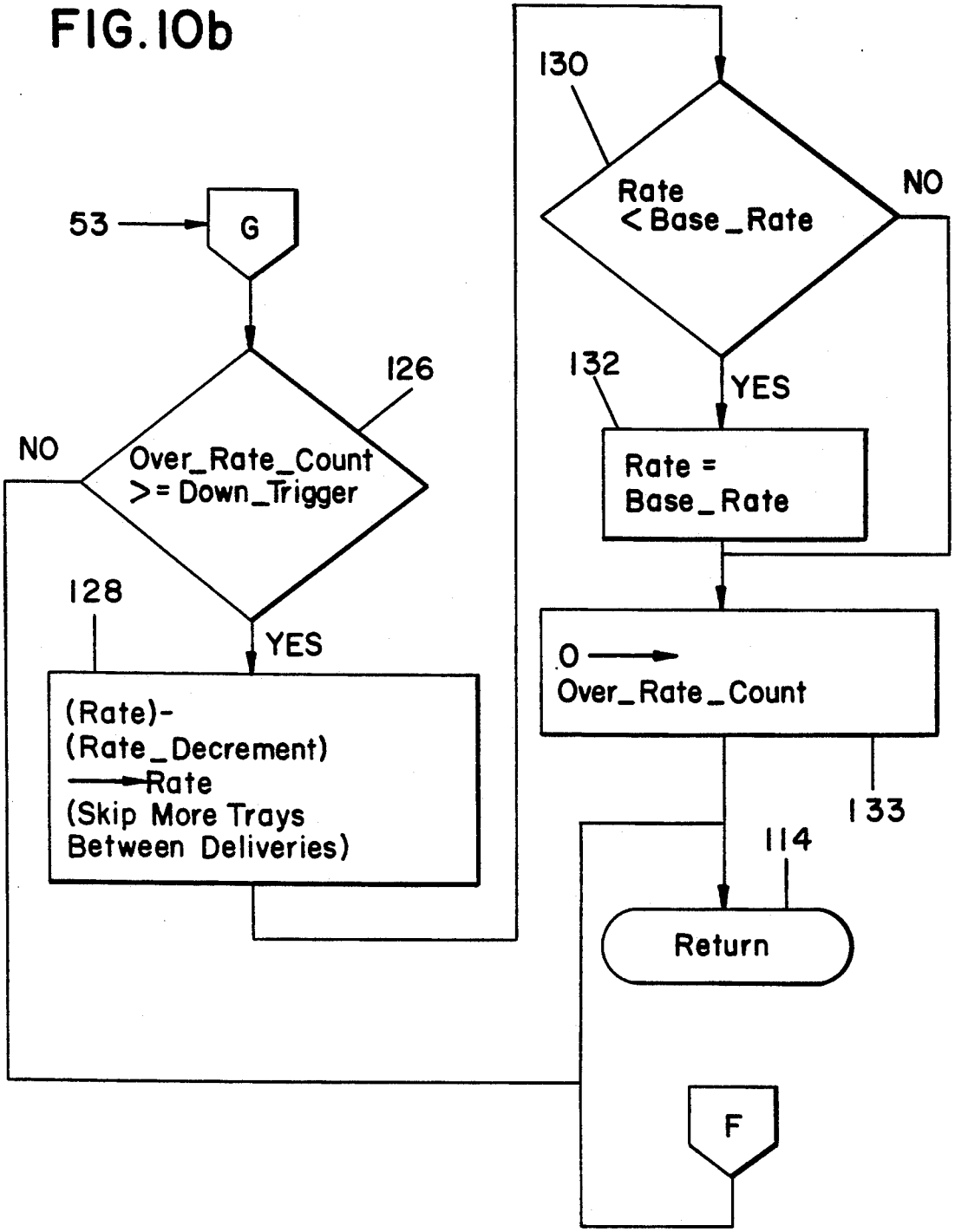
Figure 11A:
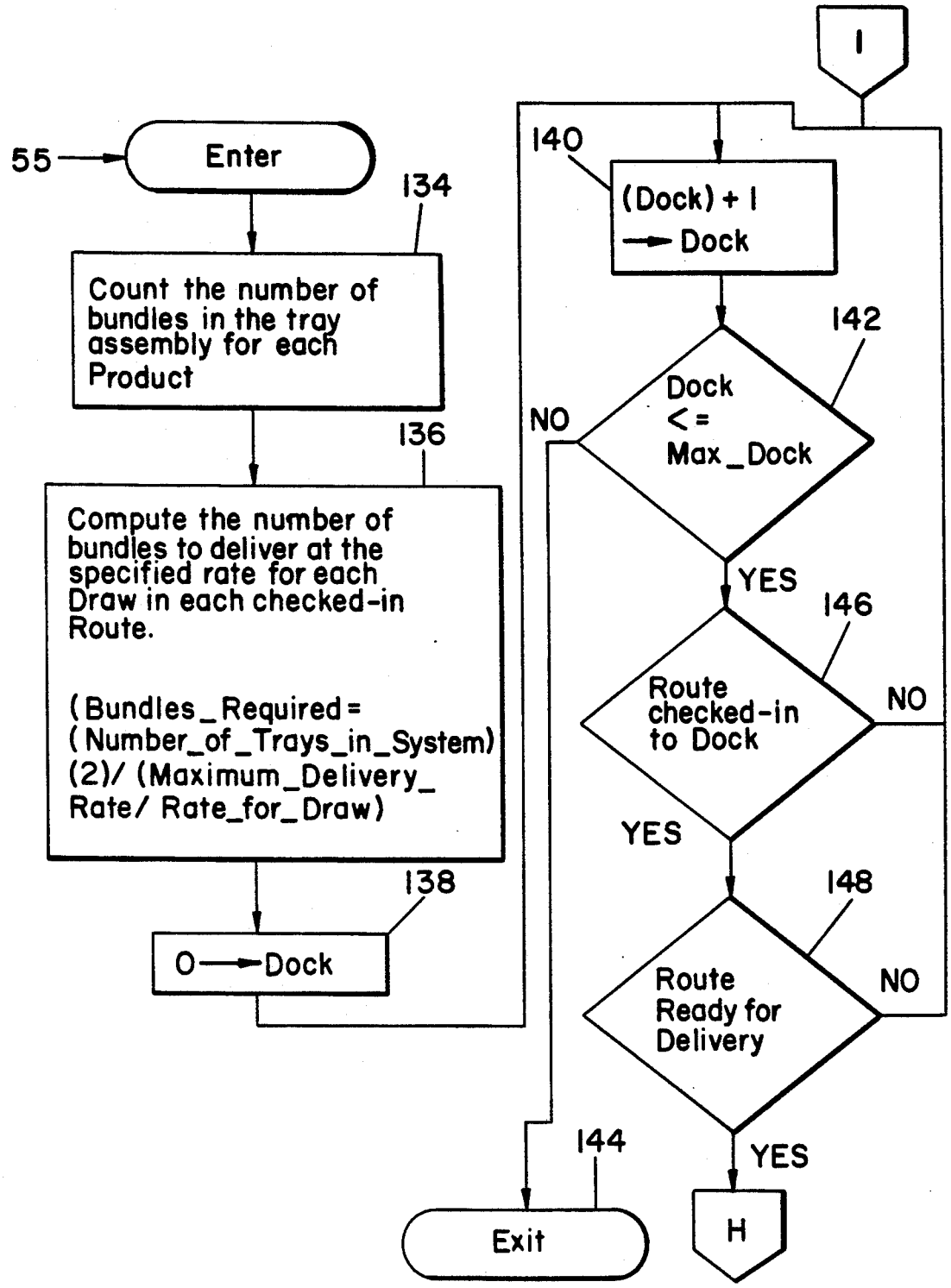
FIGS. 11*a* and 11*b* are flow charts showing the determination of priorities in the delivery system of the present invention.
Figure 11B:
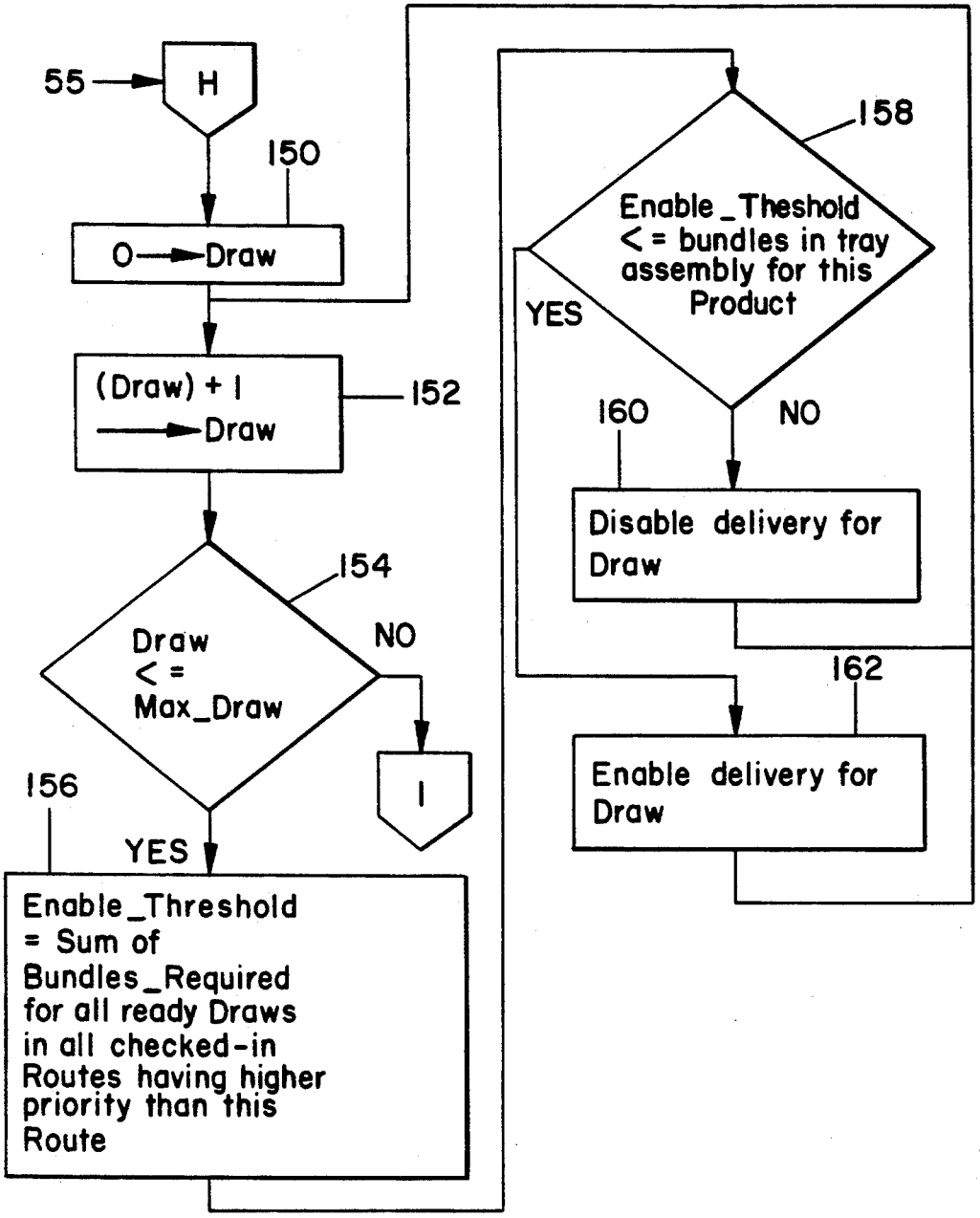

The subroutine 53 which is entered from the main program 49 is shown in FIGS. 10*a* and *b*, where the program 49 enters the subroutine 53 at the location or process 108. The term Product_Draw is initialized to 0at this location, and the program 53 passes to the location 110. The subroutine 53 increments the term Product_Draw by 1 at the location 110, and then passes to the decision 112. At this time, if the term Product_Draw is less than the term MAX Product_Draws, the program 53 passes to the end of the subroutine 53 at the location 114 where it returns to the main program 49. However, if the term Product_Draw is greater than or equal to the term MAX Product Draws, the subroutine passes on the Yes branch to the decision 116. The subroutine 53 then determines whether the selected Product_Draw is enabled or disabled. In the event that the selected Product_Draw is not ready for delivery, the program 53 returns to the location 110 in order to check further Product Draws. However, if the selected Product Draw is ready for delivery, the program 53 passes to the decision 118.

At the location 118, the term Product_ID indicates the name of the product, and the program 53 checks to determine whether the present Route or dock 46 is ready to access this product. Thus, the program 53 determines whether this product may be delivered before lowering the Current Rate. In the event that the Product_ID in the tray 38 is not the same as the Product_ID in the selected Product_Draw, the subroutine 53 returns to the location 110 where further Product Draws are checked. However, in the event that the Product_ID in the tray 38 is the same as the Product_ID in the selected Product_Draw, then program 53 passes to the location 120. Thus, the program 53 determines by the decision 118 whether the Product is required by the present Route, and that the present Route is ready to accept this product.

At the location 120, the terms Empty_Tray_Count and Under_Rate_Count are set to 0, and the subroutine 53 passes to the decision 122. The term Empty_Tray_Count has been reinitialized since there is no empty tray, and the system 20 is considering to make a delivery. The term Under_Rate_Count has been reinitialized since the system 20 is ready to make a delivery, and it is desirable to presently change the rate of delivery.

At the decision 122, if the term Current_Rate is less than or equal to the selected term Base_Rate, then the program 53 transfers to the end of the subroutine 53 at the location 114, where the subroutine 53 returns to the main program 49. However, if the term Current_Rate is greater than the term Base_Rate, then the program 53 passes to the location or process 124 in order to optimize the rate. At the location 124, the optimization parameter Over_Rate_Count is incremented by 1 in order to determine how many times the program is over this Count. The subroutine 53 then passes to the decision 126.

At the decision 126, the program 53 checks the term Over_Rate_Count against the term Down_Trigger which may be selected by the **4*n* operator in order to specify how quickly the system 20 should respond in order to lower the rate. In the event that the Over_Rate_Count is less than the term Down_Trigger, the subroutine 53 transfers to the end of the subroutine 53 at the location 114, where the subroutine 53 returns to the main program 49. However, in the event that the term Over_Rate_Count is greater than or equal to the term Down_Trigger, then the subroutine 53 passes on the Yes branch to the process or location 128**.

At the location 128 of the subroutine 53, the program 53 decreases the term Rate by the amount Rate_Decrement in order to change the term Rate by a step amount equal to the term Rate_Decrement, which may be controlled by the operator in order to skip more trays 38 between deliveries.

The subroutine 53 then passes to the decision 130 where the term Rate is checked against the term Base_Rate. In the event that then term Rate is greater than or equal to the term Base_Rate, the program 53 transfers to the location 133 where the term Over_Rate_Count is reinitialized to 0, and the subroutine then passes to the end of the program 53 at the location 114 where the subroutine 53 returns to the main program 49. However, in the event that the term Rate is less than the term Base_Rate in decision 130, the program 53 passes to the location 133 where the term Rate is set equal to the term Base Rate. In this manner, a limit is set on the rate, and the program 53 does not go under this amount.

At this time, the subroutine passes to location 133 where the term Over_Rate_Count is reinitialized to 0 in order to repeat the operation again, and the program 53 passes to the end of the subroutine 53 at the location 114 where the subroutine 53 returns to the main program 49.

The Product Overflow Optimization program 55 which controls priorities is shown as a flow chart in FIGS. **11*a* and *b*. At the location 134 where the program 55 is entered in the computer, the number of bundles in the trays 38 of the loop 40 are first counted, and then the program 55 passes to the location or process 136**.

At the location 136, first the program 55 computes the total number of bundles to be delivered at the specified rate for each Draw or Product P in each checked-in Route R. The program 55 calculates the number of bundles required in as the term or variable Bundles_Required according to the following relationship:

$$\text{Bundles_Required} = \frac{(\text{Number_of_Trays_in_System})(2)}{(\text{Maximum_Delivery_Rate})/(\text{Rate_for_Draw})}$$

where,

Bundles_Required is the number of bundles totally required in the system 20 as a fraction of the total trays required to maintain the desired rate of delivery;

Number_of_Trays_in_System is the number of total trays in the system 20;

(2) indicates that there are 2 bundles/tray; Maximum_Delivery_Rate is the maximum rate of delivery for the system 20; and Rate_for_Draw is the Base Rate.

The program 55 then determines whether there is enough of the Product to deliver the highest priority Routes at the specified rate for each Route checked in to the docks 46.

If the number of Products, such as $P_1$, exceeds the requirement of that product for the Priority 1 Route $R_1$, then the remainder of this Product $P_1$ is allocated to the priority 2 Routes $R_2$,and additional lower Priority Routes $R_2, R_3, \ldots R_n$ are also serviced so long as there is a sufficient supply using the rates and totals for these Product at this time. The Program 55 then passes to the location or process 138 where the term Dock is initialized to 0, after which the program 55 passes to the location 140 to go sequentially through the docks 46.

The program 55 increments the term Dock by 1, and passes to the decision 142. At the decision 142, if the term Dock is greater than the term Max_Dock, indicating the maximum number of docks 46, the program 55 transfers on the No branch to the location 144 where the computer exits the program 55. However, if the term Dock is less than or equal to the term Max_Dock, the program 55 passes to the decision 146 where the program verifies whether the selected dock 46 has been checked in yet. If not, the program 55 returns to the location 140 to check additional docks 46. However, if the selected dock 46 has been checked in at the decision 146, the program 55 passes on the Yes branch to the decision 148 where it is determined whether the given Route is ready for delivery. If it is not ready for delivery, the program 55 returns on the No branch to the location 140 in order to check additional docks 46. If, however, the given Route is ready for delivery, the program passes to the location or process 150. In this manner, the program checks each dock 46 in order to determine whether it has been checked in at the dock 46, and is ready for delivery.

At the location 150, the program 55 reinitializes the term Draw to 0, and passes to the location 152 where the term Draw indicating a Product is incremented by 1 for the selected Route which is ready for delivery. The program 55 then passes to the decision 154. At this time, if the term Draw is greater than the term Max_Draw, indicating the maximum number of draws or products for a Route R, the program 55 returns to the location 140 in order to check for additional docks 46 after the total number of Draws has been completed. Hence, if the term Draw is less than or equal to the term Max_Draw in the decision 154, then the program passes to the location or process 156, such that the program 55 checks all the Draws or Products for a given Route R.

At the location 156, the program 55 prepares for a check of the number of bundles or Products in other higher priority Routes. In this regard, the program 55 determines the term Enable_Threshold as the sum of Bundles_Required, the number of bundles required, for all of the ready Draws or Products in all checked in Routes R which have a higher priority than the present selected Route R, and the program 55 then passes to the decision 158.

At the decision 158, if the program 55 determines that the term Enable_Threshold is greater than the total number of bundles in the tray assembly, the program 55 transfers to the location 160 where the program 55 disables delivery for the selected Draw, and passes to the location 152 in order to check further Draws, although this Draw will be eventually enabled when sufficient bundles are available for this Product and Priority. If the program 55 determines that the term Enable_Threshold is less than or equal to the total number of bundles in the trays 38 of the tray assembly 24, then the program 55 transfer on the Yes branch to the location 162 where the delivery of the selected Draw for this Route is enabled in order to cause delivery of the Draw or Product for this Route R, after which the program 55 returns to location 152 in order to check additional Draws. As previously indicated, when the decision 154 indicates that there are more Draws than the limit Max_Draw, the program 55 returns to the location 140 in order to check additional docks 46 until all of the docks 46 have been completed, after which the program 55 transfers to the exit 144 in order to complete this program 55 which is periodically entered.

Thus, in accordance with the present invention, the system provides delivery of printed materials to Routes associated with a plurality of trucks in an improved and efficient manner. The system 20 also increases the rate of delivery of the bundles to the trucks, and distributes the bundles inn an automatic and controlled manner, with the system 20 selecting trays to be delivered from only the trays having the desired product. The system 20 also determines priority of the bundles for the trucks in an efficient manner in order to improve the distribution of the bundles in a desired manner.

The foregoing detailed description has been given for clearness of understanding only, and no unnecessary limitations should be understood therefrom, as modifications will be obvious to those skilled in the art.

What is claimed is:

1. A delivery system for a printing press, comprising:
means for receiving a quantity of printed material from the press;
means for ejecting selected printed materials from the receiving means; and
means for selecting the printed materials to be ejected, and for controlling the rate of the selecting means to eject the printed materials according to a varying rate having an average approximately equal to a selected base rate.

2. The system of claim 1 wherein the varying rate includes rates greater than the base rate, less than the base rate, and equal to the base rate.

3. The system of claim 1 including a plurality of presses, and in which the receiving means receives the printed material from the plurality of presses.

4. The system of claim 1 wherein the receiving means comprises a plurality of trays being movable past the location of the press.

5. The system of claim 4 wherein the trays are movable about a loop.

6. The device of claim 4 including a plurality of presses, and including means for loading the printed materials from the presses onto the trays.

7. The device of claim 6 wherein the ejecting means removes the materials from the trays and places the printed materials on a dock for receipt by a plurality of trucks.

8. The system of claim 7 wherein the ejecting means places the printed materials on a plurality of chutes for placement at a plurality of selected positions on a plurality of docks.

9. A delivery system, comprising:
a plurality of printing presses to supply printed materials;
a plurality of trays being movable past locations of the presses;
means for loading the trays from the passes;
means for ejecting the printed materials from the trays onto a plurality of positions on a plurality of docks for a plurality of vehicles located at the positions of the docks; and
means for selecting the trays to be ejected onto the docks according to a variable current rate having an average during delivery approximately equal to a selected base rate.

10. The system of claim 9 wherein the current rate includes values greater than, less than, or equal to the base rate.

11. The system of claim 9 including means for increasing the current rate responsive to the condition of a current rate less than the base rate.

12. The system of claim 9 including means for decreasing the current rate responsive to the condition of a current rate greater than the base rate.

13. The system of claim 9 including means for determining the priority of the positions on the dock corresponding to the vehicles.

14. The system of claim 13 including means for delivering all the printed materials to the vehicle of highest priority when the production rate of the presses is less than a selected rate for the vehicle of highest priority.

15. The system of claim 14 including means for delivering the printed materials to vehicles of successively lesser priorities when the production rate of the printing presses is greater than required to satisfy delivery to the vehicles of priorities greater than the vehicle of lesser priority.

16. The system of claim 9 wherein the printed materials comprise bundles of differing products.

17. The system of claim 16 wherein at least two bundles may be loaded onto a single tray.

18. The system of claim 9 including means for passing the trays around a loop.

19. The system of claim 9 including means for assigning trays to be delivered to different positions of the dock.

20. The system of claim 19 wherein the printed materials are assigned in an assignment window comprising a plurality of trays approaching the ejecting means for the dock.

21. The system of claim 9 wherein the ejecting means ejects the printed materials at different positions on the dock from a plurality of trays in an assignment window comprising a plurality of trays less than the total amount of trays approaching the ejecting means for delivering printed materials in the trays of the assignment window to various positions on the dock.

22. The system of claim 9 wherein the current rate represents the actual rate of delivery of the printed materials from the trays onto the dock.

23. The system of claim 9 wherein a plurality of different products are loaded onto the trays from the presses, and in which each of the delivery positions on the dock have a desired base rate, and including means for establishing a current rate of delivery for each of the products to a plurality of selected positions on the dock.

24. The system of claim 23 wherein each of the different positions on the dock have a current rate and base rate for each of the different products and for each of the plurality of delivery positions on the dock.

25. The system of claim 9 including means for increasing and decreasing the current rate.

26. The system of claim 9 including means for increasing the current rate a selected amount.

27. The system of claim 9 including means for decreasing the current rate a selected amount.

28. The system of claim 9 including means for individually checking the trays in a sequential order.

29. The system of claim 28 wherein the checking means determines the availability of the selected tray.

30. The system of claim 29 wherein the checking means determines whether a tray has been previously assigned in an assignment window for delivery to the selected tray.

31. The system of claim 29 wherein the checking means determines whether the selected tray has previously been reserved in an assignment window for the selected tray.

32. The system of claim 29 including a plurality of different products, and wherein the checking means determines whether the checked tray has a desired product for delivery.

33. The system of claim 29 wherein the checking means determines whether the selected tray has been enabled or disabled for delivery.

34. The system of claim 29 including means for decreasing the current rate responsive to a condition in the selected tray is available for delivery.

35. The system of claim 34 including a plurality of different products, and wherein the presses supply different products to the trays, and including means for determining the availability of the products for delivery.

36. The system of claim 35 including means for determining whether the current rate is greater than the base rate.

37. The system of claim 36 including means responsive to the current rate determining means for determining the rate for decreasing the current rate.

38. The system of claim 37 including means for decreasing the current rate by a selected amount.

39. The system of claim 38 including means for determining whether the current rate is less than the base rate.

40. The system of claim 39 including means responsive to the current rate determining means for utilizing the base rate for the current rate.

41. The system of claim 29 including means for increasing the current rate responsive to a condition in the selected tray is not available for delivery.

42. The system of claim 41 including a plurality of different products, and including means for determining whether a product of the plurality of different products supplied by the presses is available for delivery.

43. The system of claim 42 including means for determining the presence of a plurality of empty trays greater than a selected amount for each of the products, and means for increasing the current rate responsive to a determination of the number of trays greater than the selected amount.

44. The system of claim 43 including means for determining the rate at which the current rate is increased.

45. The system of claim 44 including means responsive to the rate determining means for increasing the current rate a selected amount.

46. The system of claim 45 including means for limiting the current rate to a maximum amount.

* * * * *